US005657041A

United States Patent [19]

Choi

[11] Patent Number: 5,657,041

[45] Date of Patent: Aug. 12, 1997

[54] METHOD FOR DRIVING A MATRIX LIQUID CRYSTAL DISPLAY PANEL WITH REDUCED CROSS-TALK AND IMPROVED BRIGHTNESS RATIO

[75] Inventor: Sun-jung Choi, Suwon, Rep. of Korea

[73] Assignee: Samsung Display Devices Co., Ltd., Kyungki-do, Rep. of Korea

[21] Appl. No.: 451,989

[22] Filed: May 26, 1995

[30] Foreign Application Priority Data

Jun. 3, 1994 [KR] Rep. of Korea ..... 94-12526

[51] Int. Cl.[6] ..... G09G 3/36

[52] U.S. Cl. ..... 345/99; 345/94

[58] Field of Search ..... 345/87, 92, 94, 345/96, 97, 99, 50; 359/54, 59, 56

[56] References Cited

U.S. PATENT DOCUMENTS

| | | | |
|---|---|---|---|
| 4,649,383 | 3/1987 | Takeda et al. | 345/94 |
| 5,119,219 | 6/1992 | Terada et al. | 345/97 |
| 5,283,564 | 2/1994 | Katakura et al. | 345/87 |

FOREIGN PATENT DOCUMENTS 0394903 10/1990 European Pat. Off. .

*Primary Examiner*—Chanh Nguyen

*Attorney, Agent, or Firm*—Leydig, Voit & Mayer

[57] ABSTRACT

A method of driving a matrix liquid crystal display (LCD) panel can improve LCD response characteristics due to an improved duty ratio, by overlapping scanning electrode driving signals internally having a positive selection pulse and a negative compensation pulse sequentially by a predetermined interval, or, at the time of driving two lines, by applying a signal whose sequence of selection pulse and compensation pulse of the scanning electrode driving signal applied thereto are reversed and overlapping a predetermined interval thereof. Also, when a data electrode driving signal is switched, since the signal is switched after maintaining an intermediate voltage level, at the interval where the scanning electrode driving signals are sequentially overlapped, a rapid change in voltage level can be prevented, that is, the data electrode driving signal variation is improved, which leads to a remarkable reduction of a waveform differential induced for a non-selection scanning electrode driving signal, thereby considerably reducing the crosstalk of an LCD.

24 Claims, 14 Drawing Sheets

FIG. 3A (PRIOR ART)
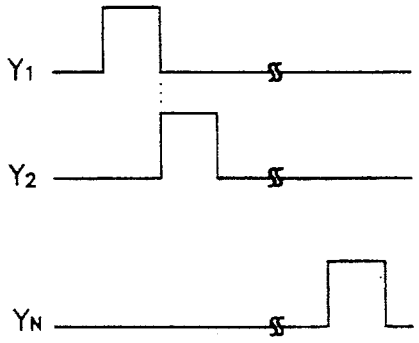
FIG. 3B (PRIOR ART)
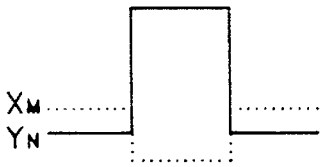
FIG. 4A (PRIOR ART)
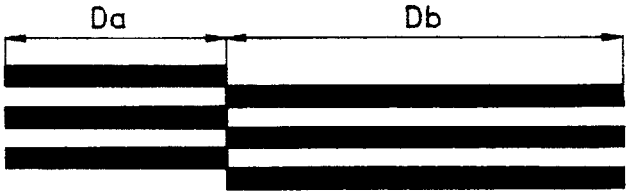
FIG. 4B (PRIOR ART)
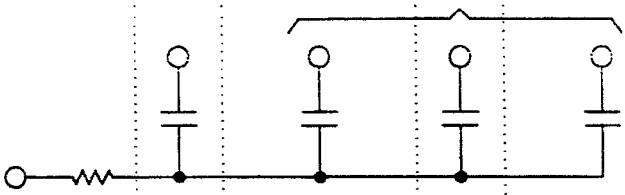
FIG. 4C (PRIOR ART)
FIG. 4D (PRIOR ART)
FIG. 4E (PRIOR ART)
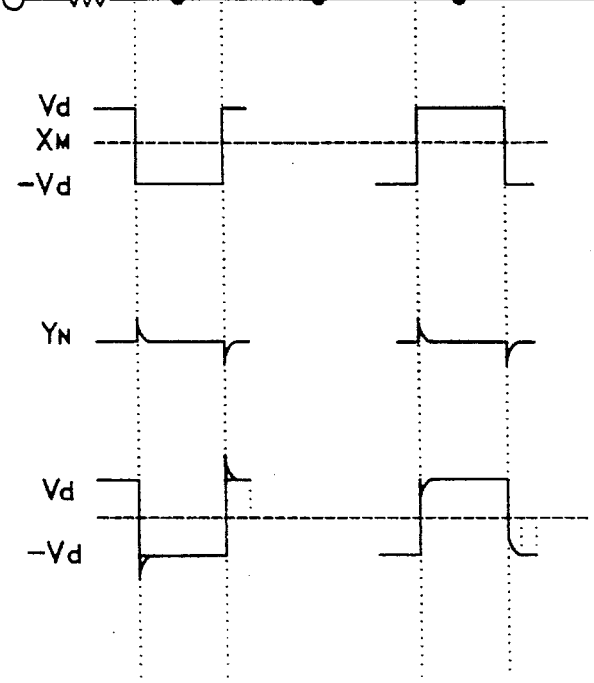

METHOD FOR DRIVING A MATRIX LIQUID CRYSTAL DISPLAY PANEL WITH REDUCED CROSS-TALK AND IMPROVED BRIGHTNESS RATIO

BACKGROUND OF THE INVENTION

The present invention relates to an apparatus and method for driving a matrix liquid crystal display (LCD) panel, and more particularly, to an apparatus and method for driving a matrix LCD panel and the method thereof, whereby the brightness ratio of liquid crystal is improved and crosstalk is prevented to give improved response characteristics.

In general, an LCD can be driven by a single-line sequential driving method (called alto-pleshko technology) by which each scanning electrode is sequentially driven, or a plural-line simultaneous driving method by which a plurality scanning electrodes are simultaneously selected and the driving signal for the corresponding data electrodes is processed and applied by a data processor. In addition, an orthogonal function driving method and an active driving method are adopted for the driving of a finer screen such as that used in a television or the like.

FIGS. 3A and 3B are waveform diagrams showing a scanning electrode driving signal and a data electrode driving signal for a conventional matrix LCD panel, respectively, and FIG. 5 is a graph showing light transmittance (T) of general liquid crystal according to the applied voltage (V) thereto.

According to the above single-line sequential driving method, when a scanning electrode Y1 is selected, in order to drive liquid crystal cells of the line corresponding thereto, data electrode driving signals X1 through XM are controlled to be simultaneously applied. As shown in FIG. 3A, this operation is repeated sequentially during one frame period until Y1 through YN are selected. In FIG. 3B, the dotted line represents a specific data electrode driving signal $X_M$, and the solid line represents state changes of scanning electrode driving signal $Y_N$, from the non-selection state to the selection state and back to the non-selection state. According to the single line sequential driving method, the number of lines is determined by a duty principle. For example, when sequentially driving 240 scanning electrodes, the scanning electrode driving signal has a duty cycle of 1/240.

FIGS. 2A to 2C are waveform diagrams for illustrating the operation of a conventional matrix LCD, which is driven by the single-line sequential driving method. FIG. 2A shows a scanning electrode driving signal and FIG. 2B shows a data electrode driving signal. Here, the scanning electrode driving signal and the data electrode driving signal are inverted in polarity in a period of one frame to then be applied, which is to prolong the life of an LCD by preventing liquid crystal deterioration. FIG. 2C shows a voltage waveform directly applied to the liquid crystal by the scanning electrode driving signal and the data electrode driving signal, the amount of which is obtained by the difference (A B) between voltages of the scanning electrode driving signal and the data electrode driving signal.

However, in a single-line sequential driving method, the more lines a display device has, the less time per line is required, thereby increasing the comparative magnitude of a driving signal in accordance with the duty concept. That is to say, as the number of lines increases, the time for a given line to be selected is reduced. Thus, the liquid crystal cells located at each line are not fully driven, which results in a deterioration of the response speed and the response characteristics of the liquid crystal itself.

Another problem is crosstalk which is an inherent display characteristic of LCDs having a simple matrix structure. FIG. 4A shows an example of images formed on a conventional matrix LCD panel; and FIGS. 4B through 4E are waveform diagrams showing the change in the effective voltage level of a liquid crystal pixel, caused by a waveform differential according to the data electrode driving signal at a non-selection scanning electrode of the matrix LCD panel having the above example of images formed thereon.

As shown in FIGS. 4B through 4E, if the data electrode driving signal undergoes a transition from a high state to a low state, or vice versa, the differential waveform is produced at a non-selected scanning electrode, thereby resulting in an increase or decrease in the effective voltage level which is directly applied to the liquid crystal.

As described above, if the effective voltage level directly applied to the liquid crystal is increased or decreased and then the state of a data electrode driving signal is not changed, in contrast to the case where a waveform differential is not induced for the non-selected scanning electrode driving signal, an error in the effective voltage levels applied to the liquid crystal is produced, which is a cause of crosstalk generated in an LCD.

Meanwhile, another method of driving liquid crystal is a plural-line simultaneous driving method by which a predetermined number of scanning electrodes form subgroups, a scanning electrode driving signal is applied in subgroup units, and the data electrode driving signal corresponding thereto is applied. A detailed exemplary operation of the plural-line simultaneous driving method is disclosed in a paper entitled "Optimal Row Functions and Algorithms for Active Addressing" (see *Digest SID* '93, pp89–92) and is mainly adopted to an LCD used for its high-speed response characteristics.

However, according to the above plural-line simultaneous driving method, the pulse width of a scanning electrode driving signal is reduced depending on the increase in the number of scanning lines, and the amplitude of the scanning electrode signal is increased. Also, since the data electrode driving signal has plural values and due to the large amplitude of the data signal, the voltage waveform induced for the scanning electrode driving signal experiences overshoot when the state of the data electrode driving signal changes, whereby the error in the effective voltage level directly applied to the liquid crystal becomes greater.

Also, in large LCD panels, since the resistance of the transparent electrode made of a material such as indium tin oxide (which is the material constituting the scanning electrodes in an LCD panel) is high, a delay in the scanning electrode driving signal is generated between the two ends of the electrodes in the liquid crystal panel. The delay of the scanning electrode driving signal causes errors in the effective voltage levels directly applied to the liquid crystal, which results in screen heterogeneity.

A solution to the above problems is disclosed in Korean Patent Application No. 93-29043 (by the applicant of the instant invention). The contents thereof will now be discussed with reference to FIG. 1 which shows a conventional matrix LCD panel and a driving apparatus therefor.

As shown in FIG. 1, the driving apparatus of a conventional matrix liquid crystal display device includes an LCD panel 5 wherein a matrix of scanning electrodes and data electrodes is formed and liquid crystal is arranged in the intersections thereof and data electrode, a controller 1 for receiving a video data signal and vertical and horizontal synchronization signals and generating a driving timing control signal and a data signal, a driving voltage generator 2 for generating a voltage signal of each level required for a driving signal to send to a data electrode driver 3 and a scanning electrode driver 4, a scanning electrode driver 4 to which the driving timing control signal is input from the controller 1 and to which the voltage signal of each level is input from the driving voltage generator 2, for generating a scanning electrode driving signal, and a data electrode driver 3 to which a driving timing control signal and data signal are input from the controller 1 and to which the voltage signal of each level is input from the driving voltage generator 2, for generating a data electrode driving signal.

The driving apparatus and method for the above matrix LCD panel will now be described.

Proper circuit operation requires an input video data signal and vertical and horizontal synchronization signals in the form of a composite video signal input to the controller 1 which thereby determines a driving timing control signal and a high or low data signal to be applied to the data electrodes of the LCD panel 5, according to either the plural-line simultaneous driving method or a single-line sequential driving method. The driving timing control signal is generated such that the driving signals applied to adjacent scanning electrodes of the LCD panel 5 overlap each other, as shown FIG. 6, wherein a waveform diagram illustrates the scanning electrode driving signals for driving a matrix LCD in one embodiment of the prior application. The data signal is generated so as to maintain an intermediate level during the time corresponding to the overlapping interval of the scanning electrode driving signal when the signal is changed from a high state to a low state, or vice versa, as shown in FIG. 7 wherein a waveform diagram illustrates a data electrode driving signal overlapping a scanning electrode driving signal for driving a matrix LCD in the above embodiment of the prior application.

FIG. 9 shows scanning electrode and data electrode driving signals according to the plural-line simultaneous driving method. In the example described herein, the scanning electrode driving signals of three lines are formed into a subgroup and orthogonal function values are applied to each line.

In the driving voltage generator 2, a voltage signal of each level necessary for the driving electrode driving signals applied to the scanning electrodes and data electrodes of the LCD panel 5 and voltage signals of an intermediate level necessary for data electrode driving signals are generated, to then be output to the data electrode driver 3 and scanning electrode driver 4.

In the scanning electrode driver 4, the corresponding voltage level of the driving voltage generator 2 is selected from the driving timing control signal input from the controller 1 and then a scanning electrode driving signal is generated. The scanning electrode driving signals are mutually overlapped for a predetermined period to then be sequentially applied to the scanning electrode of the LCD panel 5 by the driving timing control signal, as shown in FIGS. 6 and 9.

The "high" period of a scanning electrode driving signal is increased by as much as the overlap between the scanning electrode driving signals, while the "high" level thereof is decreased. In other words, since the selection time applied to the scanning electrode of the liquid crystal panel is increased, the selection ratio of the scanning data electrode is also increased (an increased scanning ratio), thereby improving the speed of the liquid crystal response.

In the data electrode driver 3, video data signals input from the controller 1 are stored in parallel. Thereafter, a voltage level corresponding to each video data signal is selected as one of the voltage signals input from the driving voltage generator 2. The voltage signals for driving the respective selected data electrodes are simultaneously applied to the data electrodes of LCD panel 5 when scanning electrode driving signals are applied to the scanning electrodes of LCD panel 5.

The data electrode driving signal is selected from among the voltage signals input from the driving voltage generator 2 by data electrode driving time control signal from the controller 1, so as to maintain an intermediate level for the duration of the overlap interval between a selection pulse of a scanning electrode driving signal and another selection pulse of an adjacent scanning electrode driving signal, as shown in FIG. 7.

As described above, when the data electrode driving signal goes from a low state to a high state, or vice versa, the signal level temporarily maintains an intermediate level which is lower than the pixel-switching level. This is for reducing a waveform differential induced for a non-selected scanning electrode by reducing the magnitude of the signal changes of the data electrode driving signal.

If the waveform differential induced for the scanning electrode driving signal is decreased, the error in the effective voltages directly applied to the liquid crystal is also reduced, thereby reducing the generation of crosstalk.

The scanning electrode driving signal is applied in one line or subgroup unit by the scanning electrode driver 4, and a data electrode driving signal is controlled so as to be applied to the data electrode of LCD panel 5 whenever the scanning electrode driving signal is applied to the LCD panel 5. Thus, each liquid crystal cell of LCD panel 5 is driven to a proper level, which results in displaying the desired picture information.

FIGS. 8A and 8B are waveform diagrams of the data electrode driving signal overlapping with the scanning electrode driving signal, in another embodiment of the prior application.

Accordingly, the above problems may be solved by merely overlapping scanning electrode driving signal. However, a problem of reduced contrast ratio still remains.

SUMMARY OF THE INVENTION

Therefore, in order to rectify the above problems and improve display characteristics of a screen, it is an object of the present invention to provide an apparatus for driving a matrix LCD which can improve such characteristics as response time and screen contrast, by simplifying the driving of the liquid crystal which is accomplished by increasing both the driving time of selected scanning electrode and the time for each scanning line to be selected (the selection ratio), to thereby provide for sufficient time for voltage to be applied to the liquid crystal, and the method therefor.

Another object of the present invention is to provide an apparatus for driving a matrix LCD which can remarkably reduce the crosstalk of liquid crystal, by reducing a waveform differential induced for a scanning electrode driving signal by multiplying the levels of a changing data electrode driving signal, that is, by reducing an instantaneous variation rate, and the method therefor.

To accomplish the above object, there is provided an apparatus for driving a matrix LCD panel according to the present invention, the apparatus comprising: driving voltage generating means for generating each voltage required for a scanning electrode driving signal applied to scanning electrodes and a data electrode driving signal applied to data electrodes; controlling means for generating a scanning electrode driving timing control signal and an overlapping control signal for sequentially driving scanning lines of a predetermined number, and a data electrode driving timing control signal and overlapping interval signal for determining whether a cell of the LCD panel is at a high or low state, by means of an input video data signal and vertical and horizontal synchronization signals, wherein the driving timing control signal makes the scanning electrode driving signal applied to mutually adjacent scanning electrodes to be overlapped by a predetermined pulse width in a positive pulse, and makes the data electrode driving signal allow the state change of input video data signal to occur through the step of maintaining an intermediate voltage level in the overlap interval of the scanning electrode driving signal; scanning electrode driving means for applying sequentially the corresponding voltages generated in the driving voltage generating means to the scanning electrodes of the LCD panel as their respective driving signals, so as to be overlapped by the driving timing control signal generated in the controlling means; and data electrode driving means for applying the corresponding voltages generated in the driving voltage generating means to the respective data electrodes of the LCD panel as the data electrode driving signal, if the scanning electrode driving signal is applied by the driving timing control signal and overlapping control signal, wherein the data electrode driving signal is applied such that the voltage level thereof changes in the overlap interval of the scanning electrode driving signal by means of the overlapping control signal.

To accomplish the above objects, there is provided a first method for driving a matrix LCD panel according to the present invention, the method comprising the steps of:

sequentially driving scanning electrodes such that scanning electrode driving signals having a negative compensation pulse and a positive selection pulse successively, whose pulse width is wider than that of the negative compensation pulse by a predetermined width, are sequentially applied to the scanning electrodes, wherein the positive selection pulses of the scanning electrode driving signals applied to adjacent scanning electrodes overlap each other by the predetermined width; and driving data electrodes such that in applying data electrode driving signals having a pulse each having first and/or second voltage levels to the data electrodes of the LCD panel, if data electrode driving signals having a positive pulse and/or negative pulse are applied to each selection pulse interval of the scanning electrode driving signals applied to the adjacent scanning electrodes, the data electrode driving signal having the second voltage level is applied, wherein a predetermined intermediate voltage level is applied interval so that the voltage level change of the data electrode driving signal to a positive pulse or to a negative pulse occurs through the step of maintaining the predetermined intermediate voltage level, in the overlap, and such that, if data electrode driving signals are applied without being changed to each selection pulse interval of the scanning electrode driving signals applied to the adjacent scanning electrodes, the data electrode driving signal having the first voltage level is applied, wherein the data electrode driving signal having the first voltage level is maintained without being changed, in the overlap interval.

In the present invention, based on the voltage level for non-selection of the scanning electrode driving signals, the absolute value of the voltage level of the selection pulse is preferably larger than that of the compensation pulse.

The predetermined intermediate voltage level of the data electrode driving signal is preferably the same as the voltage level for non-selection of the scanning electrode driving signal.

The second voltage level is preferably greater than the first voltage level by a predetermined magnitude, in terms of the absolute value.

Based on the voltage level for non-selection of the scanning electrode driving signals, the absolute value of the voltage level of the pulse of the data electrode driving signal is preferably smaller than that of the voltage level of the compensation pulse of the scanning electrode driving signal by a predetermined level.

To accomplish the above objects, there is provided a second method for driving a matrix LCD panel according to the present invention, the method comprising the steps of:

sequentially driving scanning electrodes such that scanning electrode driving signals having a negative compensation pulse and a positive selection pulse successively, whose pulse width is wider than that of the negative compensation pulse by a predetermined width, are sequentially applied to the scanning electrodes, wherein the positive selection pulses of the scanning electrode driving signals applied to adjacent scanning electrodes overlap each other by the predetermined width; and driving data electrodes such that if data electrode driving signals having a pulse are applied to each selection pulse interval of the scanning electrode driving signals applied to the adjacent scanning electrodes, the data electrode driving signals having the same absolute value for the voltage level of the pulse is applied, wherein the voltage level change of the data electrode driving signal to a positive pulse or to a negative pulse occurs within the overlap interval, and such that, if data electrode driving signals are applied without being changed to each selection pulse interval of the scanning electrode driving signals applied to the adjacent scanning electrodes, the data electrode driving signal is maintained as it is, wherein the voltage level of the pulse of the data electrode driving signal is maintained as it is in the overlap interval.

In the present invention, based on the voltage level for non-selection of the scanning electrode driving signals, the absolute value of the voltage level of a positive or negative pulse of the data electrode driving signal is preferably smaller than that of the voltage level of the compensation pulse of the scanning electrode driving signal by a predetermined level.

The voltage level change of the data electrode driving signal preferably occurs at the halfway of the interval of the scanning electrode driving signal.

To accomplish the above objects, in driving sequentially scanning electrodes coupled by two lines to form a pair of alternative first and second scanning electrodes, there is provided a third method for driving a matrix LCD panel according to the present invention, the method comprising the steps of:

sequentially driving scanning electrodes such that first and second scanning electrode signals for driving either first or second scanning electrode of the pair of first and second scanning electrodes are applied sequentially to each first and second scanning lines of the pair of the first and second scanning electrodes by setting a non-selection interval by a predetermined width, wherein the first scanning electrode driving signal having a negative compensation pulse and a positive selection pulse having a wider pulse width than that of the negative compensation pulse by a predetermined width is applied to the first scanning electrode, the second scanning electrode driving signal having a selection pulse which is the same as the selection pulse and a compensation pulse which is the same as the compensation pulse is applied to the second scanning electrode so that the selection pulses of the first and second scanning electrode driving signals form an overlap interval by the predetermined width; and driving data electrodes such that in applying data signals having a pulse having first and second voltage levels to the data electrodes of the LCD panel, if data electrode driving signals are applied to each selection pulse interval of the first and second scanning electrode driving signals, the data electrode driving signal having the second voltage level are applied, wherein a predetermined intermediate voltage level is applied so that the voltage level change of the data electrode driving signal to a positive pulse or to a negative pulse occurs through the step of maintaining the predetermined intermediate voltage level, in the overlap interval, and such that, if data electrode driving signal is applied without change to each selection pulse interval of the first and second scanning electrode driving signals, the data electrode driving signal having the first voltage level is applied, wherein the data electrode driving signal having the first voltage level is maintained without being changed.

In the present invention, the absolute value of the voltage level of the selection pulse is preferably larger than that of the compensation pulse.

The predetermined intermediate voltage level of the data electrode driving signal is preferably the same as the voltage level for non-selection of the scanning electrode driving signal.

The absolute value of the second voltage level is preferably greater than that of the first voltage level by a predetermined magnitude.

Based on the voltage level for non-selection of the scanning electrode driving signals, the absolute value of the voltage level of the pulse of the data electrode driving signal is preferably smaller than that of the voltage level of the compensation pulse of the scanning electrode driving signal by a predetermined level.

For two-line simultaneous driving, the voltage level of the data electrode driving signals is preferably maintained to be the same as that of the scanning electrode driving signal for non-selection, by setting a non-selection interval between pulses of the scanning electrode driving signal for two arbitrary lines and the next two lines, to a predetermined time interval. The non-selection interval is preferably set to be equal to the overlap interval.

In the two-line sequential driving method, the inversion of the polarity of the data electrode driving signal is preferably performed in the non-selection interval of the scanning electrode driving signal.

To accomplish the above objects, in driving sequentially scanning electrodes coupled by two lines to form a pair of alternative first and second scanning electrodes, there is provided a fourth method for driving a matrix LCD panel according to the present invention, the method comprising the steps of:

sequentially driving scanning electrodes such that first and second electrode driving signals for driving either first or second scanning electrode of the pair of the first and second scanning electrodes are applied sequentially to each first and second scanning line of the pair of the first and second scanning electrodes by setting a non-selection interval by a predetermined width, wherein the first scanning electrode driving signal having a negative compensation pulse and a positive selection pulse having a wider pulse width than that of the negative compensation pulse by a predetermined width is applied to the first scanning electrode of the pair of the first and second scanning electrodes, the second scanning electrode driving signal having a selection pulse which is the same as the selection pulse and a compensation pulse which is the same as the compensation pulse is applied to the second scanning electrode so that the selection pulses of the first and second scanning electrode driving signals form an overlap interval by the predetermined width; and driving data electrodes such that in applying data electrode driving signals having a pulse to the data electrodes of the LCD panel, if data electrode driving signals are applied to each selection pulse interval of the first and second scanning electrode driving signals, the data electrode driving signal having the same absolute value for the voltage level of the pulse is applied, wherein the voltage level change of the data electrode driving signal to a positive pulse or to a negative pulse occurs within the overlap interval, and such that, if data electrode driving signals of the sequence of a positive pulse and then a negative pulse are applied without change to each selection pulse interval of the first and second scanning electrode driving signals, the data electrode driving signal is maintained as it is, wherein the voltage level of the pulse of the data electrode driving signal is maintained as it is in the overlap interval.

In the present invention, based on the voltage level for non-selection of the scanning electrode driving signals, the absolute value of the voltage level of a positive or negative pulse of the data electrode driving signal is preferably smaller than that of the voltage of the compensation pulse of the scanning electrode driving signal by a predetermined level.

The voltage level change of the data electrode driving signal preferably occurs at the halfway of the interval of the scanning electrode driving signal.

For two-line simultaneous driving, the voltage level of the data electrode driving signals is preferably maintained to be the same as that of the scanning electrode driving signal for non-selection time, by setting a non-selection interval between scanning electrode driving signals of two arbitrary lines and the next two lines, to a predetermined time interval. The non-selection interval is preferably set to be equal to the overlap interval.

In the two-line sequential driving method, the inversion of the polarity of the data electrode driving signal is preferably performed in the non-selection interval of the scanning electrode driving signal.

BRIEF DESCRIPTION OF THE DRAWINGS

The above objects and advantages of the present invention will become more apparent by describing in detail a preferred embodiment thereof with reference to the attached drawings in which:

FIGS. 3A and 3B are waveform diagrams of a scanning electrode driving signal and a data electrode driving signal for driving a matrix LCD panel according to a conventional method;

FIG. 4A shows an example image formed on the LCD panel of FIG. 1, and FIGS. 4B to 4E are waveform diagrams illustrating the change in effective voltage levels of a liquid crystal pixel by the waveform differential caused by the data signal at a non-selected scanning electrode of the matrix LCD panel having the above example of images formed thereon;

FIGS. 12A to 12D are waveform diagrams of scanning electrode driving signals having two compensation pulses and data electrode driving signals according to first and second embodiments of the present invention, respectively, in which FIG. 12A is a waveform diagram of scanning electrode driving signals in a first embodiment of the present invention, and FIGS. 12B to 12D are waveform diagrams of data electrode driving signals in first and second embodiments of the present invention;

FIGS. 14A to 14D are waveform diagrams according to third and fourth embodiments of the present invention, in which FIG. 14A is a waveform diagram of scanning electrode driving signals and FIGS. 14B to 14D are waveform diagrams of data electrode driving signals.

DETAILED DESCRIPTION OF THE INVENTION

Figure 10:
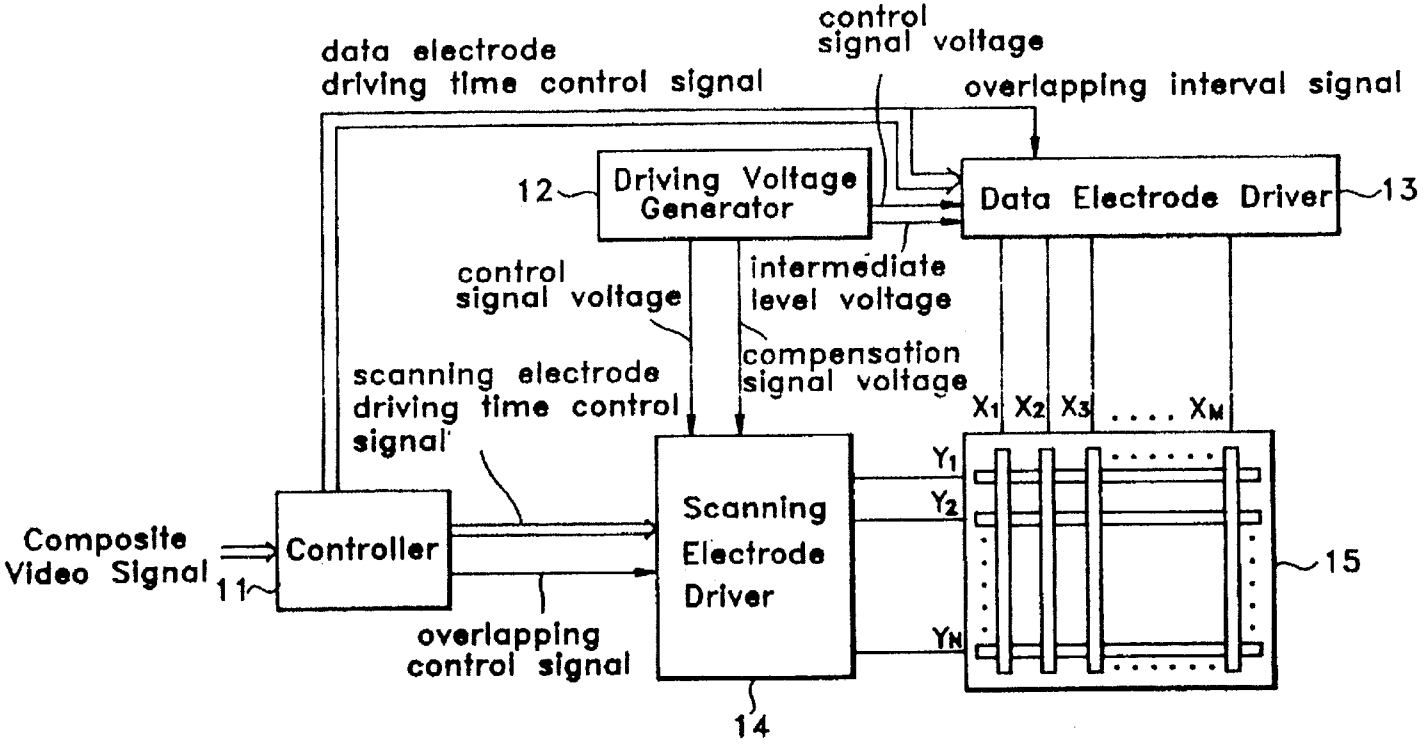
FIG. 10 is a schematic diagram of the matrix LCD and the apparatus for driving the same according to the present invention.
Figure 11A:
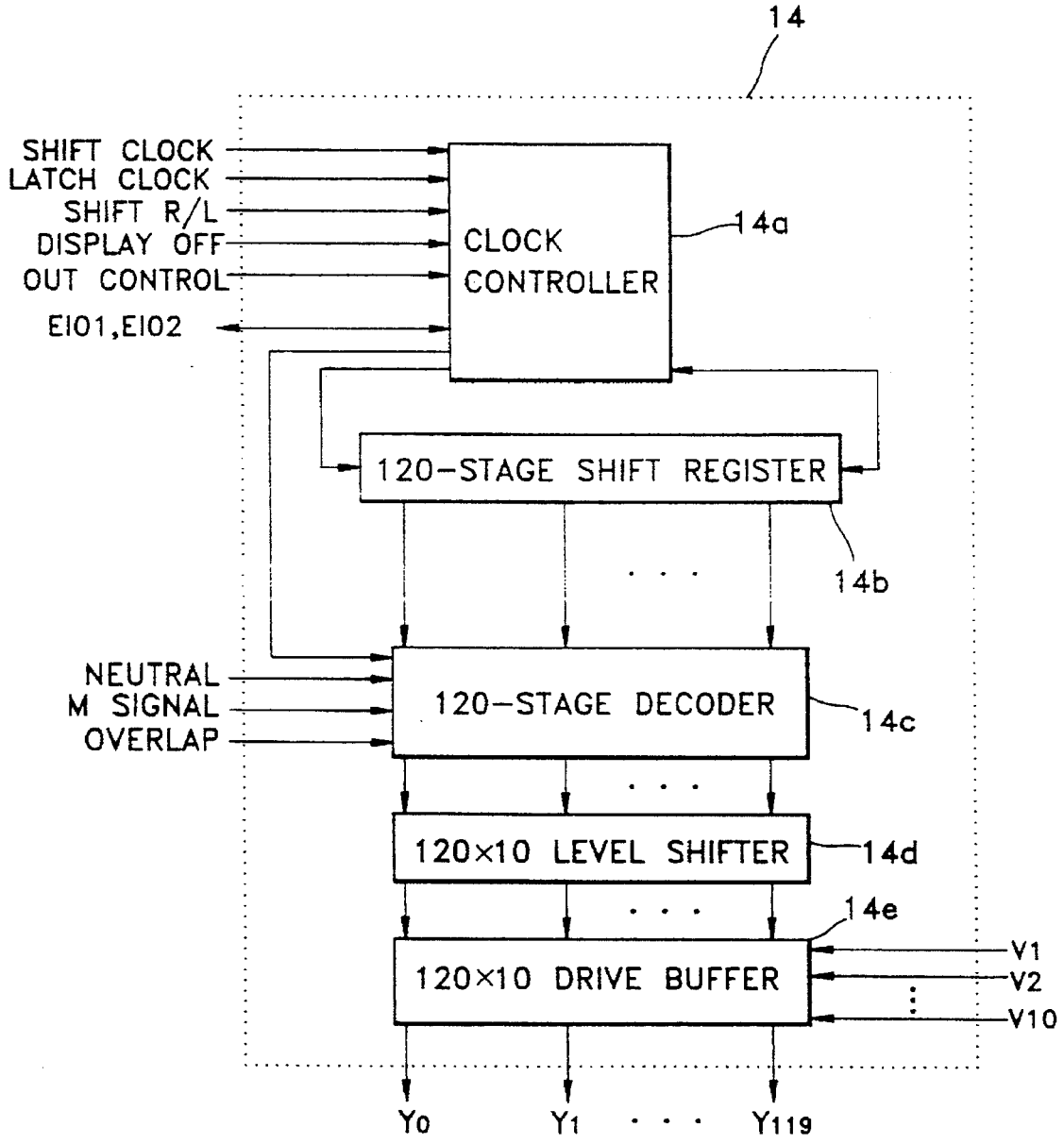
FIGS. 11A and 11B are block diagrams showing signal flows of the scanning electrode driver and data electrode driver shown in FIG. 10, respectively.
Figure 11B:
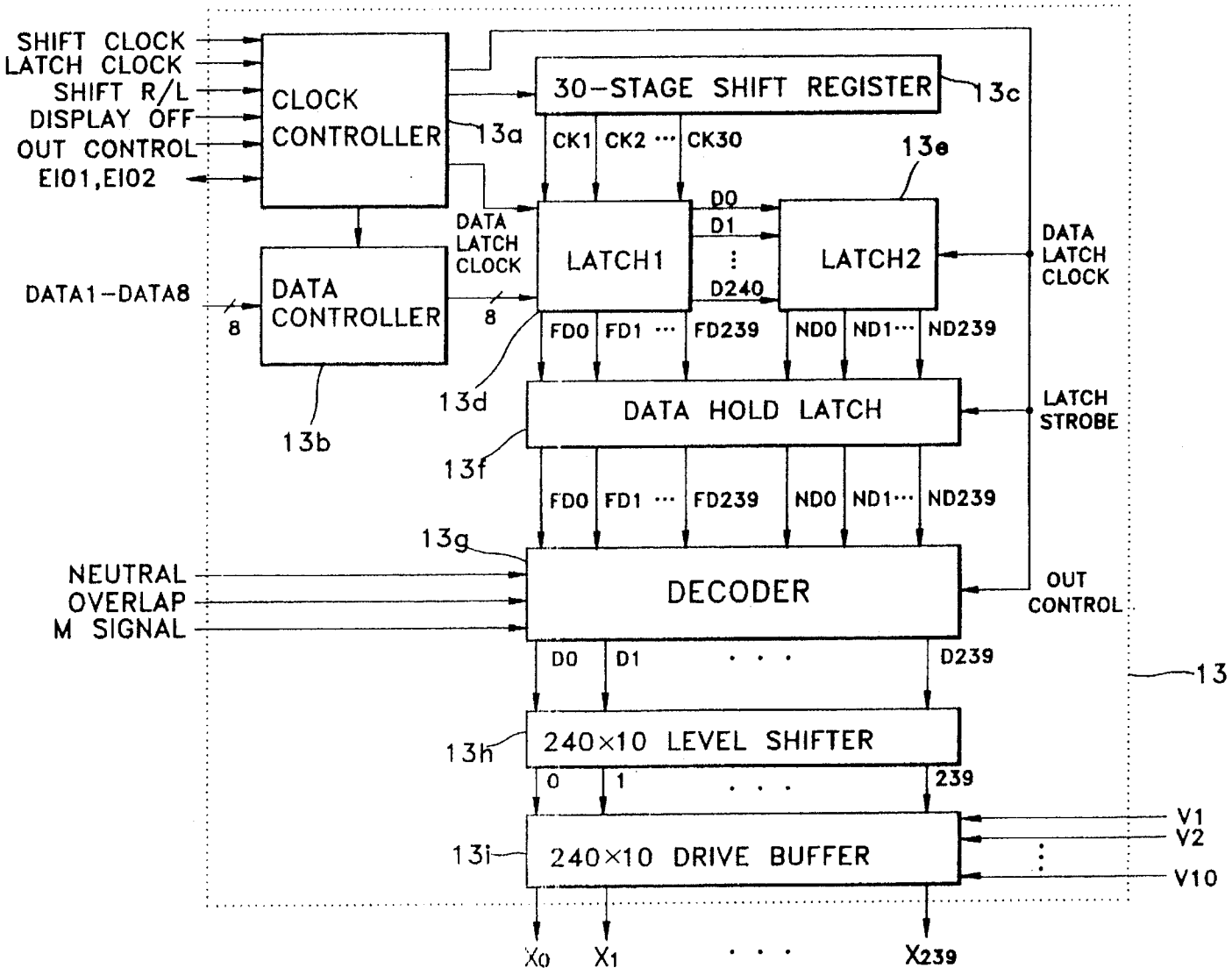

The configuration of the matrix LCD panel according to the present invention and the scanning electrode driver and data electrode driver of the apparatus for driving the same, which are shown in FIGS. 10, 11A and 11B, will now be described.

There are provided an LCD panel 15 and a driving voltage generator 12 for generating the respective voltage levels of a scanning electrode driving signal and a data electrode driving signal each applied to scanning electrodes Y1, Y2, . . . , YN and data electrodes X1, X2, . . . , XM of the LCD panel 15. The respective voltage levels include the intermediate voltage level of the data electrode driving signal.

There is also provided a controller 11 for generating a driving timing control signal for sequentially driving one line or simultaneously driving a plurality of lines, and a data electrode driving signal for determining the image voltage level of the LCD cell, from an input video data signal and vertical and horizontal synchronization signals (composite video signal). Also, the driving timing control signal generated in the controller 11 makes the positive selection pulses of the respective scanning electrode driving signals applied to mutually adjacent scanning electrodes be overlapped by a predetermined pulse width, and makes the change of the voltage level of the data electrode driving signal consisting of the positive and negative pulses occur in the overlap interval of the scanning electrode driving signal, that is, makes the voltage level change up or down through the step of maintaining the intermediate level in the overlap interval of scanning electrode driving signal or makes the voltage level change up or down directly within the overlap interval.

There is provided a scanning electrode driver 14 for applying sequentially the corresponding levels of voltage levels generated in the driving voltage generator 12 to the scanning electrodes of the LCD panel 15 as their respective driving signals, so as to be overlapped by the driving timing control signal generated in the controller 11. The scanning electrode driver 14 includes a clock controller 14*a*, a 120-stage shift register 14*b*, a 120-stage decoder 14*c*, a 120×10 level shifter 14*d* and a 120×10 drive buffer 14*e*, as shown in FIG. 11A. Here, EI01 and EI02 are connection ports used for input and output between integrated circuits, V1, V2, . . . , V10 are voltage levels necessary for forming a scanning electrode signal, an M signal, neutral and overlap are control signals for forming scanning electrode driving signals by using the various voltage levels V1~V10. Specifically, the M signal is a control signal for changing signal polarity, and the neutral and overlap are control signals for forming a compensation area which is the characteristic feature of the present invention.

Also, there is provided a data electrode driver 13 for applying the voltage level of the driving voltage generator 12 corresponding to the data electrode driving signal, to the respective data electrodes of the LCD panel as a data electrode driving signal, if a scanning electrode driving signal is applied in accordance with a driving timing control signal and the data electrode driving signal generated in the controller 11, and for applying a data electrode driving signal having a pulse so that the voltage level thereof changes through the step of maintaining an intermediate voltage level in the overlap interval of the scanning electrode driving signal or changes directly up or down within the overlap interval. The data electrode driver 13 includes a clock controller 13*a*, a data controller 13*b*, a 30-stage shift register 13*c*, two latches (1st and 2nd) 13*d* and 13*e*, a data hold latch 13*f*, a decoder 13*g*, a 240×10 level shifter 13*h* and a 240×10 drive buffer 13*i*, as shown in FIG. 11B. Here, EI01 and EI02 are connection ports used for input and output between integrated circuits, V1, V2, . . . , V10 are the various voltage levels necessary for forming data electrode driving signals, DATA1 to DATA8 are the connection ports for applying the 8-bit video data signal per channel to data controller 13*b*. An M signal, neutral and overlap are control signals for forming a data electrode driving signal by using the various voltage levels V1~V10. Specifically, the M signal is a control signal for changing polarity of signals, and neutral and overlap are control signals for forming compensation area which is the characteristic feature of the present invention.

Figure 12A:
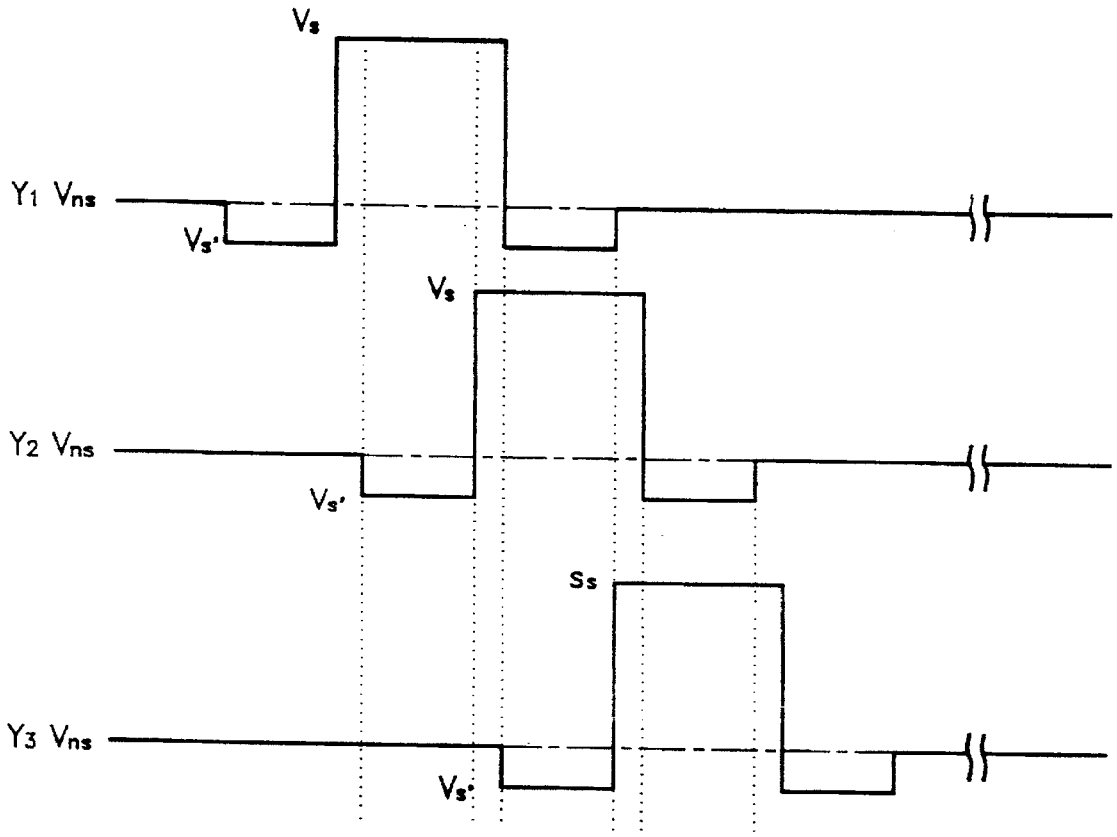
Figure 12B:
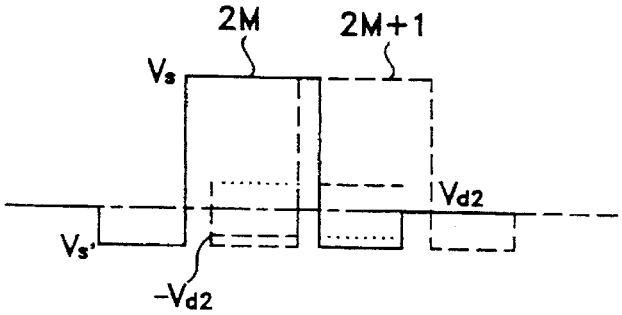
Figure 12C:
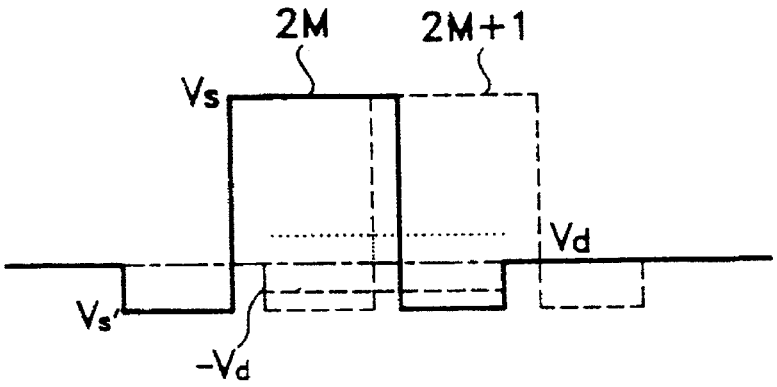

FIGS. 12A to 12C, showing a first embodiment of the present invention, are waveform diagrams of a scanning electrode signal and a data electrode driving signal at the overlap interval thereof, when driving scanning electrodes of a matrix LCD by sequentially overlapping by one line with a scanning electrode driving signal having a negative compensation pulse.

Figure 1:
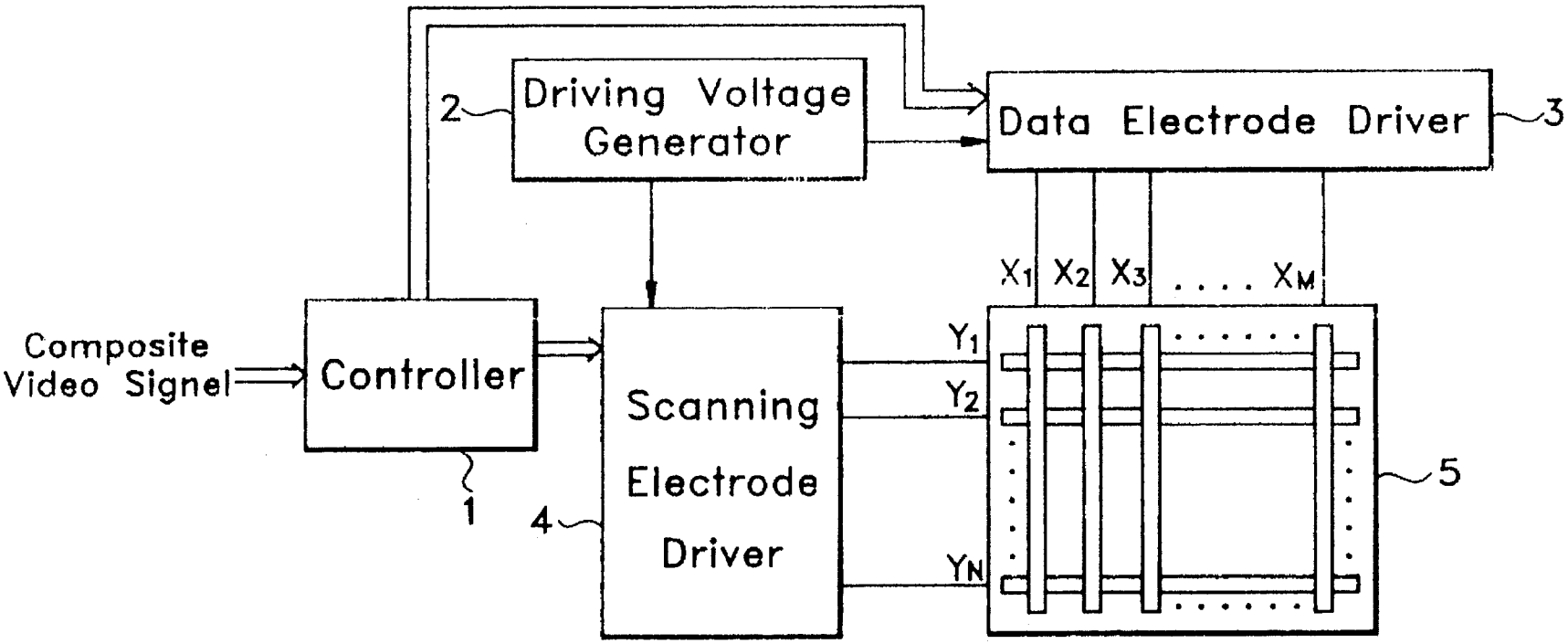
FIG. 1 (PRIOR ART)
FIG. 1 is a schematic diagram of a general matrix LCD panel and an apparatus for driving the same.
Figures 2A, 2B, 2C:
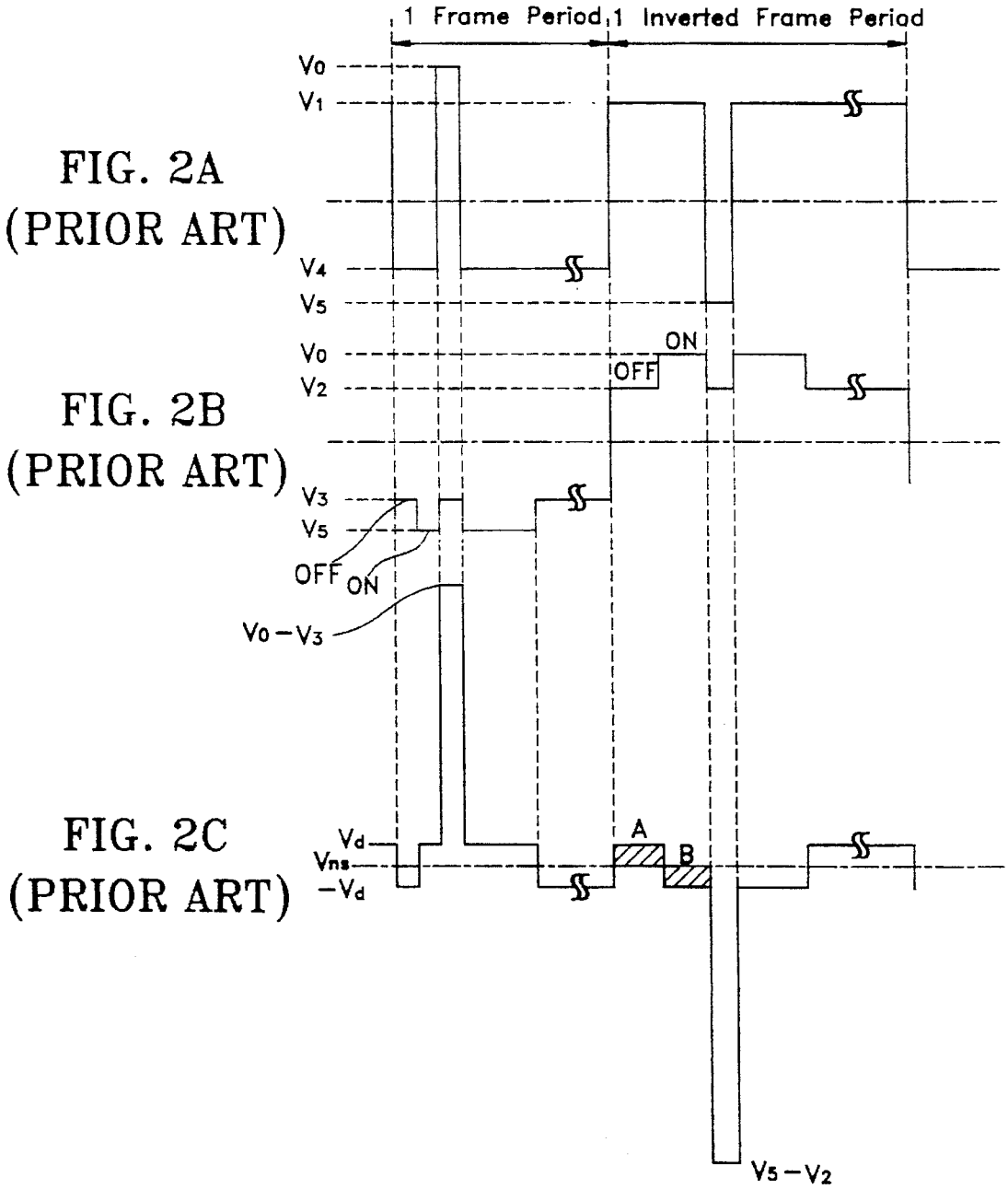
FIG. 2A (PRIOR ART)
FIG. 2B (PRIOR ART)
FIG. 2C (PRIOR ART)
FIGS. 2A to 2C are waveform diagrams of a signal for driving a matrix LCD panel according to a conventional method.
Figure 5:
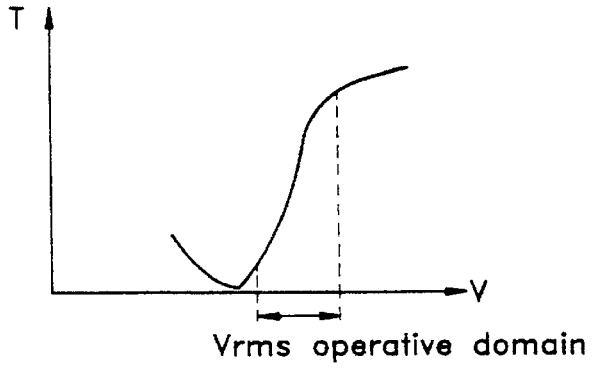
FIG. 5 is a graph showing a light transmitting characteristic according to the applied voltage for general liquid crystal.
Figure 6:
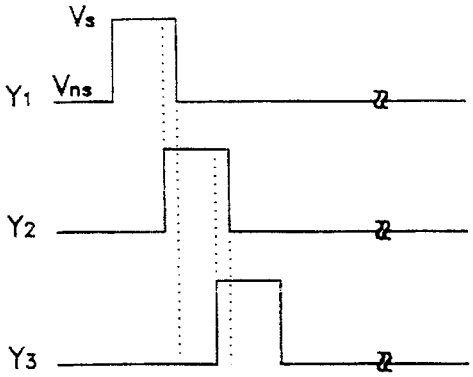
FIG. 6 PRIOR ART
FIG. 6 shows a waveform diagram of scanning electrode driving signals overlapped for driving the matrix LCD panel shown in FIG. 1.
Figure 7:
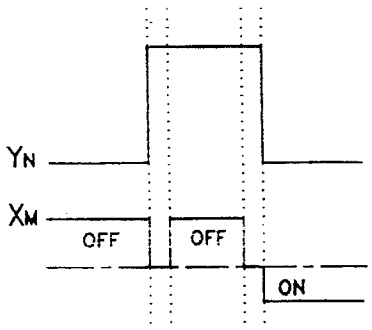
FIG. 7 PRIOR ART
FIG. 7 shows waveform diagrams of data electrode driving signals overlapping scanning electrode driving signals for the matrix LCD panel shown in FIG. 1.

Here, a negative compensation pulse whose level is $V_s'$ having the opposite polarity with respect to $V_s$ is adopted to the scanning electrode driving signal whose level is $V_s$ at a selection state and $V_{ns}$ at a non-selection state, as shown in FIG. 6. In this manner, by overlapping a predetermined portion between the scanning electrode signals with the compensation pulse adopted, a selection ratio of the scanning electrode driving signal, that is, duty ratio, is improved, thereby improving the LCD's response characteristics. Also, by making the voltage level of a data electrode driving signal consisting of first or second voltage levels smaller than that of a compensation pulse of a scanning electrode driving signal in terms of absolute value, the adverse effects of the waveform differential caused by the change in the voltage levels of the data electrode driving signal on the scanning electrode can be minimized.

Also, as shown in FIG. 12B, when a data electrode driving signal applied to data electrode undergoes a transition from a positive pulse to a negative pulse or vice versa, the data electrode driving signal of the second voltage level is switched in the overlap interval of two adjacent scanning electrodes after maintaining an intermediate voltage level. At this time, the magnitude of the intermediate voltage of the data signal is set equal to that of the voltage level $V_{ns}$ at the non-selection state. In this manner, by making the data electrode driving signal change after maintaining the intermediate voltage level, the magnitude of the waveform differential induced for the adjacent non-selection scanning electrode is made small, and the ratio of waveform differential of pixel-applied voltages for a scanning electrode signal and data electrode driving signal, for ultimately driving the liquid crystal, is reduced. Therefore, since the variation of effective pixel voltage depending on the waveform differential is small, crosstalk is decreased considerably.

Figure 8A:
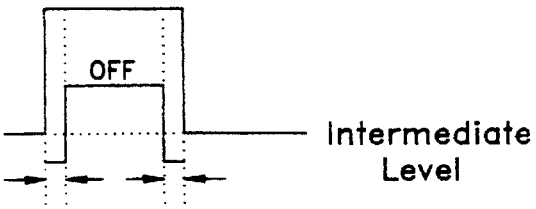
FIG. 8A PRIOR ART
FIGS. 8A and 8B are waveform diagrams of data electrode driving signals overlapping scanning electrode driving signals for the matrix LCD panel shown in FIG. 1.
Figure 8B:
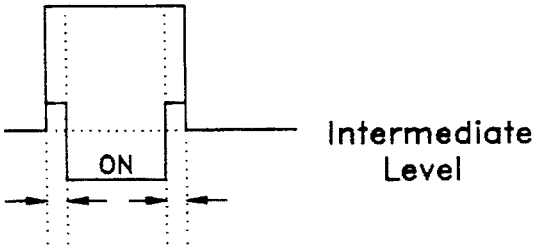
FIG. 8B PRIOR ART
Figure 9:
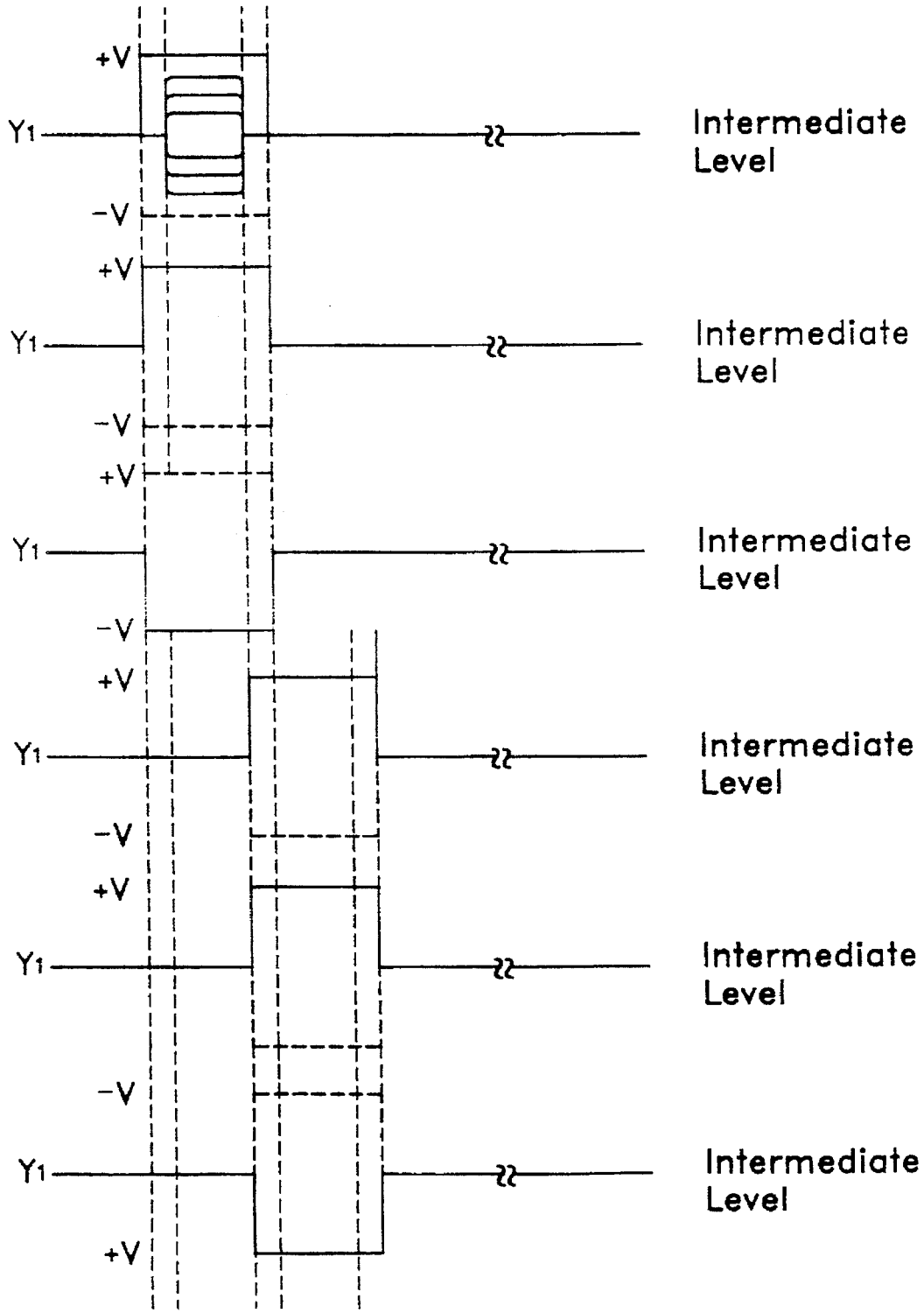
FIG. 9 PRIOR ART
FIG. 9 shows waveform diagrams of scanning electrode driving signals for the matrix LCD panel shown in FIG. 1, in the case of simultaneously driving a plurality of improved scanning electrodes.

Also, as shown in FIG. 12C, if the data electrode driving signal of the first voltage level is not changed, the level of the corresponding positive (or negative) pulse is not changed; nor are the data signal voltage levels in the overlap interval of adjacent scanning electrode signals. Then, compared to the case shown in FIG. 8, the LCD according to the present invention can be driven with a high-quality picture.

Meanwhile, when the voltage level of a data electrode driving signal is changed, in forming images, the absolute value of the second voltage level is preferably larger than that of the first voltage level which corresponds to the case when the state thereof is not changed. In other words, when the voltage level of a data electrode driving signal is changed, in order to obtain sufficient effective power for driving pixels, a much larger voltage level is necessary.

Figure 12D:
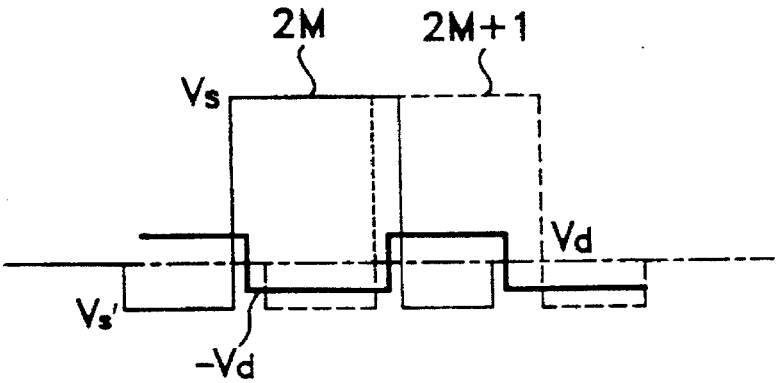

In FIG. 12D showing a second embodiment of the present invention, when a data electrode driving signal applied to a data electrode is switched from a negative pulse (on) to a positive pulse (off) or vice versa, the data electrode driving signal is switched during the overlap interval of two adjacent scanning electrodes. At this time, the voltage level of the data electrode driving signal is made smaller than that of the negative compensation pulse of the scanning electrode driving signal, thereby comparatively reducing the ratio of a waveform differential of pixel-applied voltages for the scanning electrode signal and data electrode driving signal, for ultimately driving the liquid crystal. Therefore, since the variation of an effective pixel voltage depending on the waveform differential is small, crosstalk is considerably reduced. Also, in this manner, when the data electrode driving signal is changed during the overlap interval of the scanning electrode driving signal, the voltage level of the data electrode driving signal is set equal to that obtained when the voltage level of the data electrode driving signal is not changed.

Figure 13:
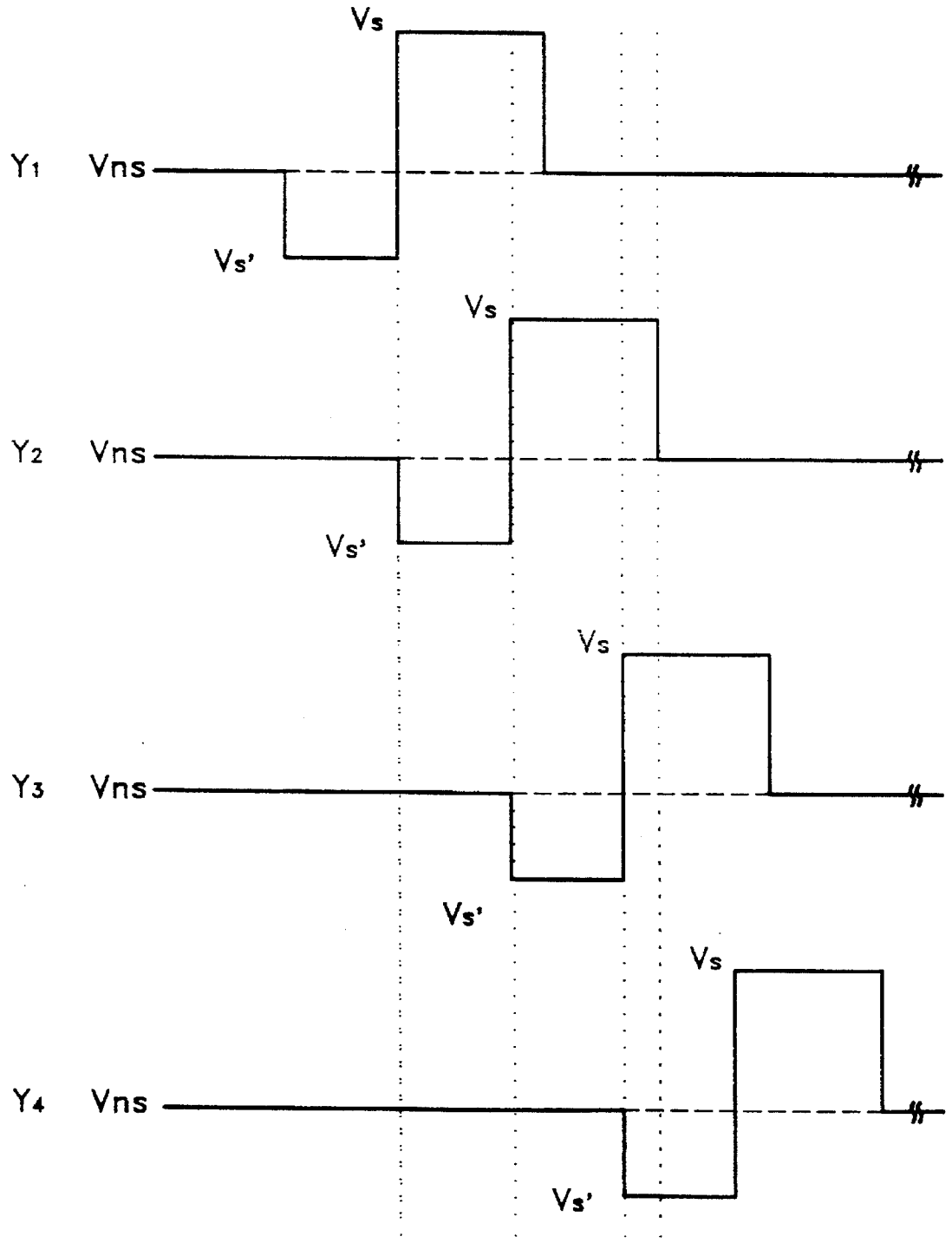
FIG. 13 is a waveform diagram of scanning electrode signals having one compensation pulse in a second embodiment of the present invention.

FIG. 13 is a waveform diagram of scanning electrode signals having one compensation pulse when sequentially driving the scanning electrodes of a matrix LCD according to the present invention, which shows another a method for driving the scanning electrode signal having two compensation pulses as shown in FIG. 12A. At this time, the data electrode driving signal as shown in FIGS. 12B to 12D may be also applied to data electrodes.

Figure 14A:
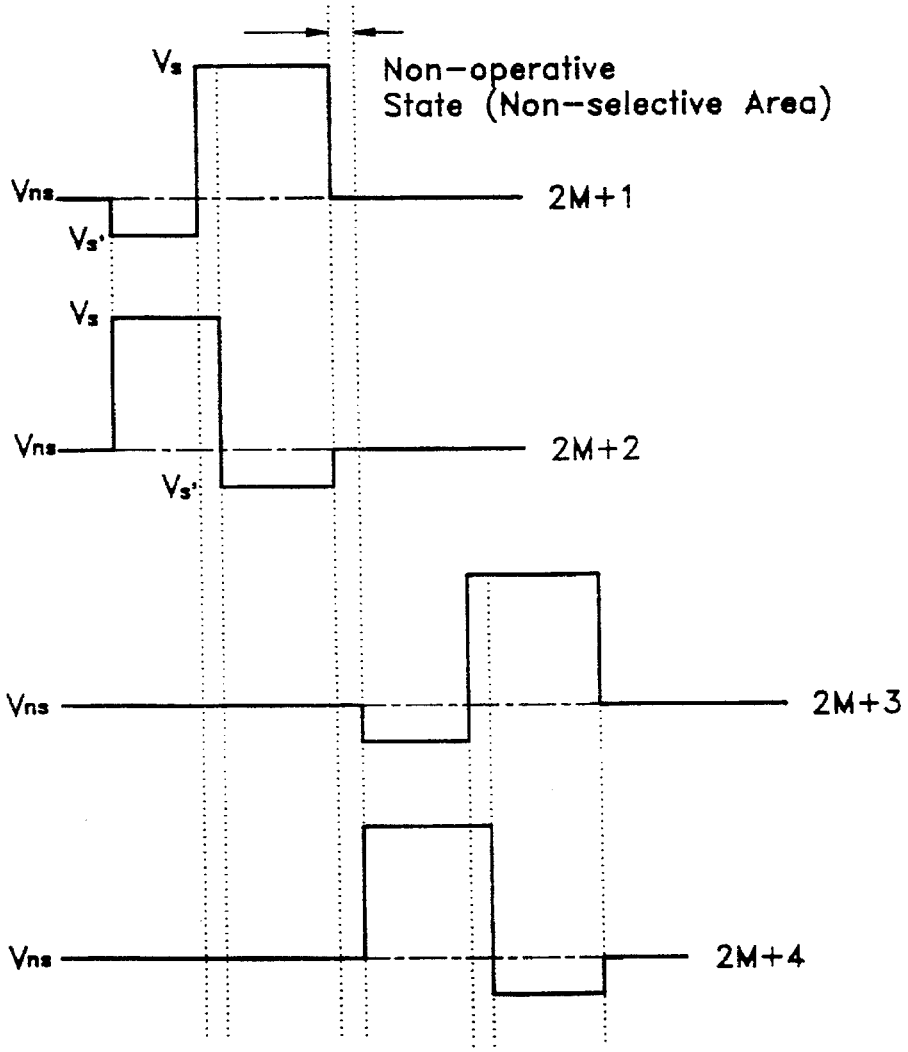
Figure 14B:
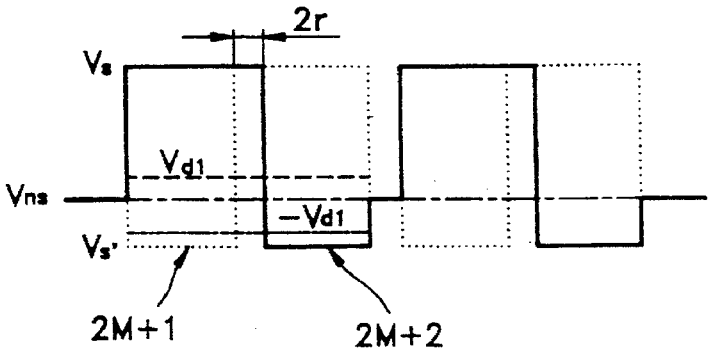

FIGS. 14A and 14B, showing a third embodiment of the present invention, are waveform diagrams of a scanning electrode signal and data electrode driving signal being at the overlap interval thereof when driving scanning electrodes of a matrix LCD panel according to the present invention, by sequentially overlapping by two lines simultaneously with a scanning electrode driving signal having a compensation pulse.

When the scanning electrode lines of the LCD panel are coupled by two lines (referred to as a first or second scanning electrode line) to then be sequentially driven, the scanning electrode driving signals with the reverse-sequence selection/compensation pulse combination are applied to the above two lines. In other words, as shown in FIG. 14A, if the scanning electrode driving signal going from compensation pulse to selection pulse is applied to the first electrode scanning line, the scanning electrode driving signal going from selection pulse to compensation pulse is applied to the second electrode scanning line. If the scanning electrode is driven by sequentially overlapping the scanning electrode lines by two lines, the magnitude of the selected scanning electrode driving signal is reduced considerably more than that of single-line sequential driving, thereby increasing the time during which each scanning line is selected, increasing the time for voltage to be applied to liquid crystal pixel, and ultimately improving the response characteristic of the liquid crystal. As shown in FIG. 14A, when the scanning electrode lines of liquid crystal are coupled by two to then be sequentially driven, the scanning electrode driving signals with the reverse-sequence of the positive selection pulse and negative compensation pulse are applied to the above two lines. In other words, if the scanning electrode driving signal going from compensation pulse to selection pulse is applied to the first electrode scanning line, the scanning electrode driving signal going from selection pulse to compensation pulse is applied to the second electrode scanning line, or vice versa, thereby making the scanning electrode driving signals be applied to the two lines at the same time. As the result, an overlap interval is produced between selection pulses of the scanning electrode driving signals respectively applied to first and second scanning electrodes.

At this time, when the data electrode driving signal applied to the data electrode is changed from a positive pulse to a negative pulse, or vice versa, the change is made to occur within the overlap interval of selection pulse of (2M+1)th scanning electrode driving signal and that of (2M+2)th scanning electrode driving signal. Also, when the voltage level of the data electrode driving signal is maintained as the positive pulse or negative pulse, without change, the voltage level is also maintained without change in the overlap interval.

Figure 14C:
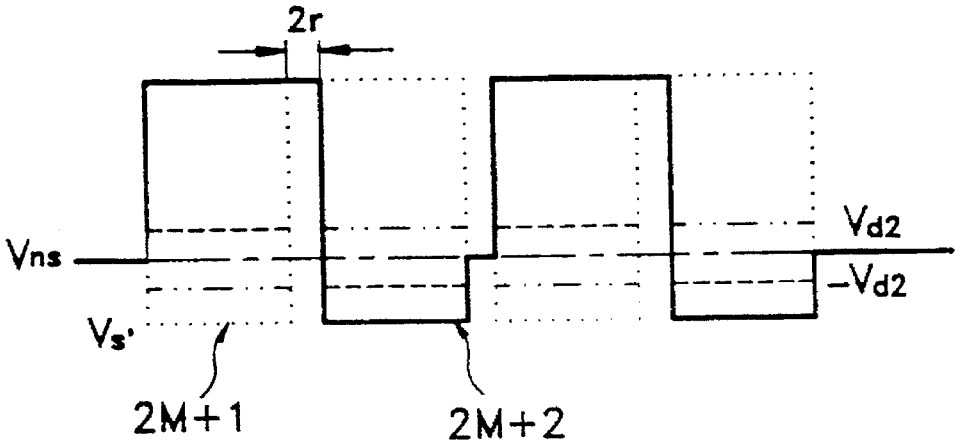
Figure 14D:
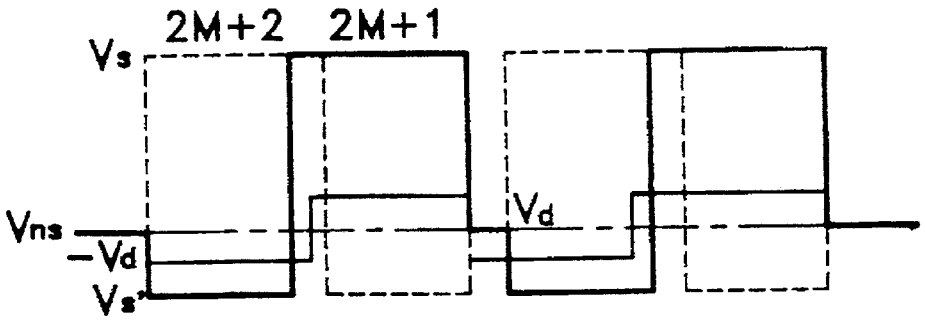

Here, as shown in FIG. 14C, when the data electrode driving signal is changed from the positive pulse to the negative pulse or vice versa, the voltage level is made to be changed after maintaining intermediate voltage level $V_{ns}$ within the overlap interval of the selection pulse of the scanning electrode driving signal of the (2M+1)th line and that of the scanning electrode driving signal of the (2M+2)th line, or, to be directly changed during the above overlap interval, as shown in FIG. 14D showing a fourth embodiment of the present invention. Since the instantaneous voltage variation becomes small if the voltage level maintains intermediate voltage level $V_{ns}'$ for a predetermined time and then is changed, the waveform differential induced for the scanning electrode becomes small, which means a small variation of the effective pixel voltage, thereby reducing crosstalk. If the voltage is directly changed during the above overlap interval, the actual circuit implementation is easy.

Also, two-line-scanning electrode driving signals having either pulse sequence (compensation pulse-to-selection pulse or selection pulse-to-compensation pulse) are applied to adjacent two line scanning electrodes with a period of non-operative state (non-selection period), as shown in FIG. 14A. All data electrode driving signals have the same level as the reference voltage level of the scanning electrode driving signals at the non-operative state, and a polarity inversion of the liquid crystal is also produced.

As shown in FIG. 14B, in two-line sequential driving, the scanning electrode driving signals sequentially overlapped are symmetrical with respect to each other based on the intermediate of the overlap interval of selection pulse of the (2M+1)th scanning electrode driving signal and selection pulse of the (2M+2)th scanning electrode driving signal. That is to say, the driving method thereof gives a homogeneous screen by driving the first frame as (1,2), (3,4), . . . , (N 1, N) and the second frame as (2,3), (4,5), . . . , (N, 1). Therefore, the effective voltage applied to the electrodes is balanced. Here, as described above, the data electrode driving signals are switched during the overlap interval of the selection pulse of the scanning electrode driving signal of the (2M+1)th line and the selection pulse of the scanning electrode driving signal of the (2M+2)th line.

FIGS. 14B and 14C show overlapped scanning electrode driving signals applied to two scanning lines when sequentially driving scanning electrodes of the matrix LCD according to the present invention by two lines at a time, with a scanning electrode driving signal having a compensation pulse, and are waveform diagrams of voltage levels of the data electrode driving signals at the overlap interval of the selection area of the scanning electrode signal of a (2M+1)th line and the selection area of the scanning electrode signal of a (2M+2)th line. According to this method, when an LCD is driven by two lines, scanning time (duty ratio) is increased by overlapping the scanning time between two scanning electrodes by a predetermined overlap interval (**2*r*), thereby improving the response characteristic of the device. Also, when the logic state of display data is changed (on-to-off or off-to-on), the above overlap interval (2*r***) is secured as an intermediate level of the display data, thereby reducing the magnitude of instantaneous variation of data electrode driving signal by 40% or more. Thus, the generation of the waveform differential produced when data electrode driving signal is changed is reduced, thereby reducing the luminance error generation phenomenon. Optimal driving conditions for the driving method according to the present invention can be obtained by such a system.

In order to secure the optimal driving conditions, the scanning electrode driving signal drives simultaneously each pair of adjacent electrodes and is composed of a selection pulse $V_s$ and compensation pulse $V_s'$. When the scanning electrode is at a non-selection state, a non-selection voltage level $V_{ns}$ is maintained. Meanwhile, when there is no logic state transition for two adjacent pixels, the data electrode driving signal maintains voltage level $+V_{d1}$ or $V_{d1}$, as shown in FIG. 14B. However, if the display data of two adjacent pixels represents a change in logic state, the data electrode driving signal is changed sequentially from $V_{d2}$ to zero to $+V_{d2}$ or from $+V_{d2}$ to zero to $V_{d2}$, during the scanning time for two electrodes, as shown in FIG. 14C. Here, zero represents the voltage level $V_{ns}$ during the overlap interval. Also, referring to FIGS. 14B and 14C, the voltages should be applied so as to satisfy the relationship $|V_{d1}|<|V_{d2}|$. This is so that the voltage level $V_{d2}$ of the data electrode driving signal should be slightly increased in order to assure the effective AC value which is a voltage necessary for driving liquid crystal pixels when the data electrode driving signal is changed. This is exemplified by the experimental data shown in Table 2 to be described subsequently. Thus, in general, the scanning electrode driving signal has three levels, and the data electrode driving signal has five levels since the respective absolute values of low and high levels are different when the data electrode driving signal is changed and when the signal is not changed.

As described above, the effective voltage $V_{ONrms}$ applied when a pixel is on, and the effective voltage $V_{OFFrms}$ applied when a pixel is off, are expressed by the following equations.

$$V_{ONrms}=\sqrt{\frac{(1+r)(V_S+V_{d1}^2)+(1-r)(V_S'-V_{d1})^2+(N-2)V_{d1}^2}{N}} \quad (1)$$

$$V_{OFFrms}=\sqrt{\frac{(1+r)(V_S+V_{d1})^2+(1-r)(V_S'-V_{d1})^2+(N-2)V_{d1}^2}{N}} \quad (2)$$

Here, r is an overlap ratio of a scanning signal, and N is the number of scanning electrodes constituting a screen. The value of $V_{d2}$ with respect to $V_{d1}$ is derived from the following formulas for the effective voltage value applied to an LCD at a non-selection period.

$$2V_{d1}^2 = 2(1-r)V_{d2}^2 \quad (3)$$

$$V_{d2} = V_{d1}\sqrt{\frac{1}{1-r}} \quad (4)$$

Also the value of $V_s'$ is obtained from the following formula for the effective voltages when the data electrode driving signal maintains the "on" state and for an on/off transition.

$$V_s' = V_s\left(\frac{1+r-\sqrt{1-r}}{1-r+\sqrt{1-r}}\right) \quad (5)$$

Here, the variable "a" can be substituted for the term in the parentheses.

$V_s$ and $V_{d1}$ satisfying that $V_{OFFrms}$ equals $V_{th}$, are obtained from the above formulas (1), (2) and (5) as follows.

$$V_s = V_{d1}\sqrt{\frac{N(1+r)-a(1-r)}{(1+r)^2-a(1-r^2)+a^2(1-r^2)-a^3(1-r)}} \quad (6)$$

Here the variable "b" can be substituted for the square root value.

Then, we can say that $$V_{d1} = V_{th}\sqrt{\frac{N}{b^2(1+r)-2b(1+r)+a^2b^2(1-r)-2ab(1-r)+N}} \quad (7)$$

Table 1 indicates voltage levels of data signals for the display status of each pixel.

TABLE 1

| pixel status (2M+1) | pixel status (2M+2) | data signal (2M+1) | overlap interval | data signal (2M+2) |
|---|---|---|---|---|
| ON | ON | $-V_{d1}$ | $-V_{d1}$ | $-V_{d1}$ |
| ON | OFF | $+V_{d2}$ | 0 | $-V_{d2}$ |
| OFF | ON | $-V_{d2}$ | 0 | $+V_{d2}$ |
| OFF | OFF | $+V_{d1}$ | $+V_{d1}$ | $+V_{d1}$ |

At the time of an AC inversion for changing the state of a pixel, the respective data signals become reversely polarized.

The following Table 2 indicates data obtained at optimal driving conditions while varying the overlap ratio of a scanning signal by 10%, 25% and 50%, and data for the conventional magnitude selection method, assuming that the data electrodes and scanning electrodes number 320 and 240, respectively, and the threshold voltage $V_{th}$ of a liquid crystal pixel is 2 V.

TABLE 2

| item | conventional driving system (magnitude selection) | proposed overlap driving system 10% | 25% | 50% |
|---|---|---|---|---|
| scanning signal | | | | |
| $V_s$ | 22.65 | 21.52 | 19.9 | 17.38 |
| $V_s'$ | 0 | −1.76 | −4.727 | −11.42 |
| data signal | | | | |
| $V_{d1}$ | 1.462 | 1.46 | 1.459 | 1.444 |
| $V_{d2}$ | 1.462 | 1.54 | 1.684 | 2.04 |
| data signal variation (V) | 2.924 | 1.54 | 1.684 | 2.04 |
| number of scanning lines | 240 | 240 | 240 | 240 |
| number of effective scanning lines (duty ratio increased by overlap) | 240 | 218 | 192 | 160 |
| on/off selection ratio | 1.0668 | 1.065 | 1.063 | 1.059 |
| operative voltage | 0.1335 V | 0.13 V | 0.126 V | 0.12 V |
| duty ratio improvement | reference (0%) | 9.1% | 20% | 33.3% |
| data signal variation | reference (100%) | 52.6% | 57.5% | 69.7% |
| scan signal width increase | reference (1) | 1.1 | 1.25 | 1.5 |

As shown in Table 2, an overlap driving system is improved with respect to duty ratio by 9.1%, 20% and 33.3% at 10%, 25% and 50% overlaps, respectively, compared to the conventional system, thereby having such number of effective scanning lines of a liquid crystal device by the increase of the duty ratio as the cases of the ones having 218, 192 and 180 scanning lines of the case of the conventional method. Meanwhile, a heterogeneity phenomenon of a screen due to luminance error can be improved by 40% or more. In spite of such an improvement in the operational characteristics, the reduction in the on/off selection ratio of a pixel is too slight to affect the operating voltage of a liquid crystal pixel. In other words, this method can improve the luminance homogeneity of a screen by improving the liquid crystal response characteristics due to an improvement in duty ratio, and by reducing luminance error due to reduced data signal variation, without a severe reduction of the optimal driving conditions (maximum on/off selection ratio) for a simple matrix LCD.

Figure 15:
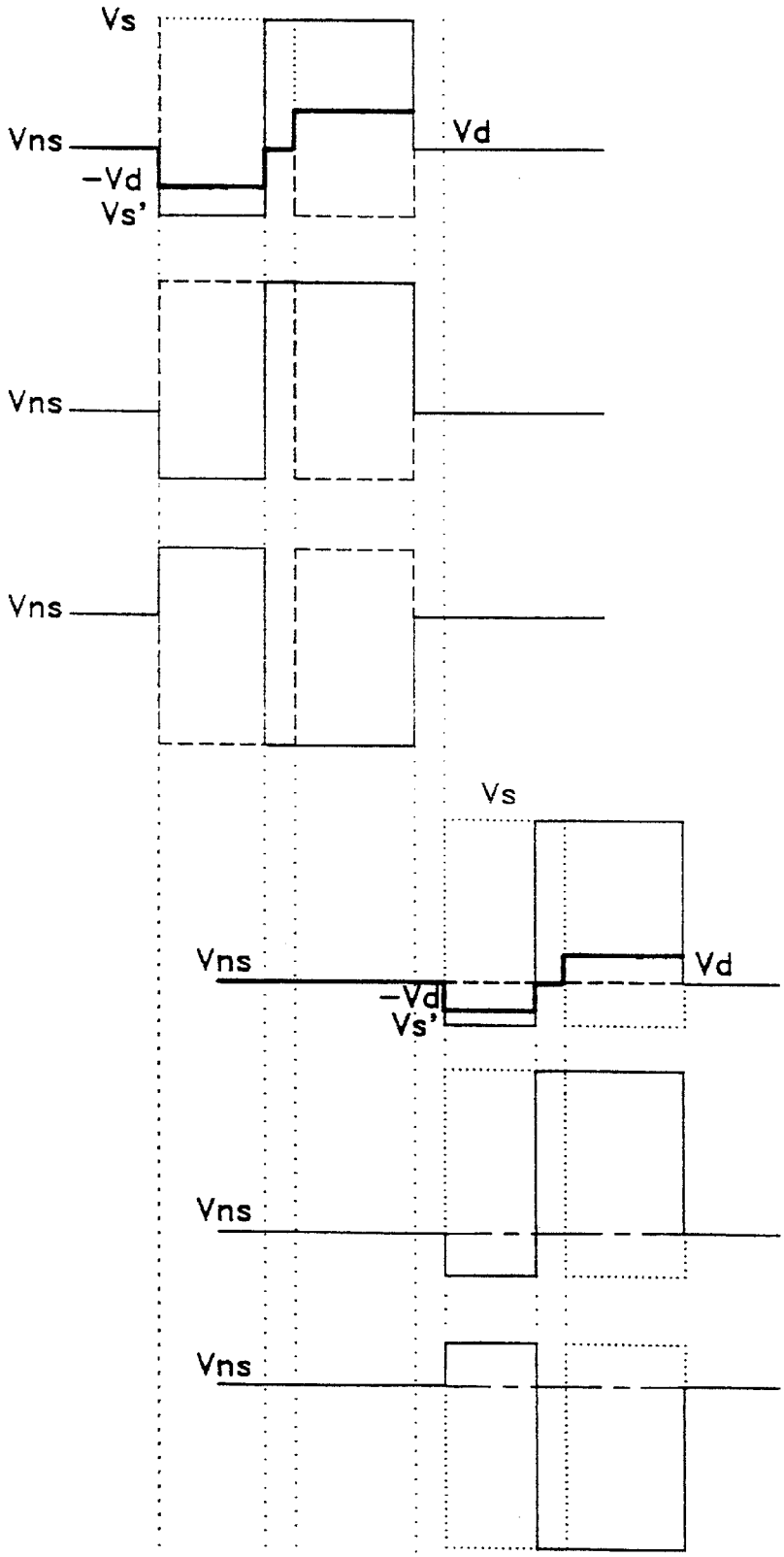
FIG. 15 shows waveform diagrams of scanning electrode signals and data electrode driving signals when driving the matrix LCD according to the present invention, by sequentially overlapping a plurality of lines thereof at once by an orthogonal function with scanning electrode driving signals having a compensation pulse.

FIG. 15 shows waveform diagrams of a scanning electrode driving signal and data electrode driving signal when driving a matrix LCD panel according to the present invention by sequentially overlapping a plurality of lines thereof at a time with a scanning electrode driving signal having a compensation pulse. Referring to FIG. 15, three lines of scanning electrodes are coupled in subgroups so that scanning electrode driving signals, each having orthogonal function values, are applied to each line.

As described above, the method of driving a matrix LCD panel according to the present invention can improve the response characteristics of an LCD due to an improved duty ratio by overlapping scanning electrode driving signals having a sequential positive selection pulse and negative compensation pulse, by a predetermined interval, or, when driving two lines, by applying a scanning electrode driving signal whose selection-compensation pulse sequence is reversed and overlapping a predetermined interval thereof. Also, when a data electrode driving signal undergoes a polarity transition, since the signal polarity switch occurs after maintaining an intermediate voltage level, at the interval where the scanning electrode driving signals are sequentially overlapped, a rapid change in voltage level can be prevented. That is, the data electrode driving signal variation is improved, which leads to a remarkable reduction of a waveform differential induced for a non-selection scanning electrode driving signal, thereby considerably reducing the crosstalk of an LCD.

What is claimed is:

1. A method for driving a matrix LCD panel comprising:

sequentially driving scanning electrodes with scanning electrode driving signals having, successively, a negative compensation pulse and a positive selection pulse, the positive selection pulse having a pulse width wider than that of the negative compensation pulse by a predetermined width, wherein the positive selection pulses of the scanning electrode driving signals applied to adjacent scanning electrodes overlap each other by the predetermined width in an overlap interval; and driving data electrodes with pulsed data signals having first and second voltage levels so that during each selection pulse interval and the scanning electrode driving signals are applied to adjacent scanning electrodes and the data electrode driving signal having the second voltage level is applied to a data electrode, a predetermined intermediate voltage level is applied to the data electrode during a voltage change in the data electrode driving signal during the overlap interval, and when data electrode driving signals are applied without change during each selection pulse interval when the scanning electrode driving signals are applied to adjacent scanning electrodes, the data electrode driving signal having the first voltage level is applied to the data electrode, the data electrode driving signal having the first voltage level being maintained without change during the overlap interval.

2. The method for driving a matrix LCD panel as claimed in claim 1, wherein the absolute value of the voltage level of the selection pulse is larger than the voltage level of the compensation pulse.

3. The method for driving a matrix LCD panel as claimed in claim 1, wherein the second voltage level is larger than the first voltage level by a predetermined magnitude.

4. The method for driving a matrix LCD panel as claimed in claim 1, wherein the absolute value of voltage level of the data electrode driving signal is smaller than the voltage level of the compensation pulse of the scanning electrode driving signal by a predetermined level.

5. The method for driving a matrix LCD panel as claimed in claim 1, wherein a signal-line sequential driving method including the steps of driving scanning electrodes by overlapping the selection pulses of said scanning electrode driving signals by said predetermined width and changing the voltage level of said data electrode driving signals via a predetermined intermediate level voltage in said overlap interval of said scanning electrode signals, is also adopted for a plural-line simultaneous driving method by which scanning electrodes are simultaneously driven in units of subgroups formed of plural-lines of scanning electrodes.

6. The method for driving a matrix LCD panel as claimed in claim 1, wherein the scanning electrode driving signals include the negative compensation pulse, the positive selection pulse, and the negative compensation pulse, successively.

7. A method for driving a matrix LCD panel comprising sequentially driving scanning electrodes with scanning electrode driving signals having, successively, a negative compensation pulse and a positive selection pulse, the positive selection pulse having a pulse width wider than that of the negative compensation pulse by a predetermined width, wherein the positive selection pulses of the scanning electrode driving signals applied to adjacent scanning electrodes overlap each other by the predetermined width in an overlap interval; and driving data electrodes with pulsed data electrode driving signals applied during each selection pulse interval of the scanning electrode driving signals applied to adjacent scanning electrodes, wherein a voltage level change in the data electrode driving signal occurs within the overlap interval, and when data electrode driving signals are applied without change in each selection pulse interval the voltage level of the data electrode driving signal is maintained without change during the overlap interval.

8. The method for driving a matrix LCD panel as claimed in claim 7, wherein the absolute value of the voltage level of the data electrode driving signal is smaller than the voltage level of said compensation pulse of the scanning electrode driving signal by a predetermined level.

9. The method for driving a matrix LCD panel as claimed in claim 7, wherein the voltage level change of the data electrode driving signal occurs midway in the overlap interval.

10. The method for driving a matrix LCD panel as claimed in claim 7, wherein a scanning-line sequential driving method including the steps of driving scanning electrodes by overlapping the selection pulses of said scanning electrode driving signals by said predetermined width and changing the voltage level of said data electrode driving signals in said overlap interval of said scanning electrode signals, is also adopted for a plural-line sequential driving method by which scanning electrodes are sequentially driven in units of subgroups formed of plural-lines of scanning electrodes.

11. The method for driving a matrix LCD panel as claimed in claim 7, wherein the scanning electrode driving signals include the negative compensation pulse, the positive selection pulse, and the negative compensation pulse, successively.

12. A method for sequentially driving scanning electrodes of a matrix LCD panel, the scanning electrodes being coupled in pairs of alternating first and second scanning electrodes, the method comprising:

sequentially driving scanning electrodes with first and second scanning electrode driving signals applied to each of said pair of first and second scanning electrodes by establishing a non-selection interval having a predetermined width, wherein the first scanning electrode driving signal includes a negative compensation pulse and a positive selection pulse, the positive selection pulse having a wider pulse width than the negative compensation pulse by a predetermined width, applied to said first scanning electrode, the second scanning electrode driving signal having a selection pulse identical to the selection pulse of the first scanning electrode driving signal and a compensation pulse identical to the compensation pulse of the first scanning electrode driving signal, applied to said second scanning electrode so that the selection pulses of the first and second scanning electrode driving signals form an overlap interval of the predetermined width; and driving data electrodes with pulsed data signals having first and second voltage levels so that during each selection pulse interval when the first and second scanning electrode driving signals are applied, the data electrode driving signal having the second voltage level is applied to a data electrode so that a voltage level change in the data electrode driving signal occurs while a predetermined intermediate voltage level is applied to the data electrode during the overlap interval, and, when the data electrode driving signal is applied without change during each selection pulse interval of the first and second scanning electrode driving signals, the data electrode driving signal having the first voltage level is applied to the data electrode and the first voltage level is maintained without change.

13. The method for driving a matrix LCD panel as claimed in claim 12, wherein the absolute value of the voltage level of the selection pulse is larger than the voltage level of the compensation pulse.

14. The method for driving a matrix LCD panel as claimed in claim 12, wherein the magnitude of the second voltage level is larger than that of the first voltage level.

15. The method for driving a matrix LCD panel as claimed in claim 12, wherein the absolute value of the voltage level of a pulse of the data electrode driving signal is smaller than the voltage level of the compensation pulse of the scanning electrode driving signal.

16. The method for driving a matrix LCD panel as claimed in claim 12, wherein, the voltage level of the data electrode driving signals is the same as that of the scanning electrode driving signal in the non-selection interval.

17. The method for driving a matrix LCD panel as claimed in claim 12, wherein the non-selection interval is equal to the overlap interval.

18. The method for driving a matrix LCD panel as claimed in claim 12, including inverting the data electrode driving signal during the non-selection interval of the scanning electrode driving signal.

19. A method for sequentially driving scanning electrodes of a matrix LCD panel, the scanning electrodes being coupled in pairs of alternating first and second scanning electrodes, the method comprising:

sequentially driving scanning electrodes with first and second scanning electrode driving signals applied to each of said pair of first and second scanning electrodes by establishing a non-selection interval having a predetermined width, wherein the first scanning electrode driving signal includes a negative compensation pulse and a positive selection pulse, the positive selection pulse having a wider pulse width than the the negative compensation pulse by a predetermined width, applied to said first scanning electrode, the second scanning electrode driving signal includes a selection pulse that is identical to the selection pulse of the first scanning electrode driving signal and a compensation pulse that is identical to the compensation pulse of the first scanning electrode driving signal, applied to said second scanning electrode so that the selection pulses of the first and second scanning electrode driving signals form an overlap interval of the predetermined width; and driving data electrodes with pulsed data electrode driving signals during each selection pulse interval, wherein a voltage level change of the data electrode driving signal occurs in the overlap interval, and, when data electrode driving signals including a positive pulse and a negative pulse sequentially are applied to a data electrode without change during each selection pulse interval, the data electrode driving signal is maintained without change and the voltage level of the pulse of the data electrode driving signal is maintained without change during the overlap interval.

20. The method for driving a matrix LCD panel as claimed in claim 19, wherein the absolute value of the voltage level of the data electrode driving signal is smaller then the voltage level of said compensation pulse of the scanning electrode driving signal by a predetermined level.

21. The method for driving a matrix LCD panel as claimed in claim 19, wherein the voltage level change of the data electrode driving signal occurs midway in the overlap interval.

22. The method for driving a matrix LCD panel as claimed in claim 19, wherein in the sequentially driving of two lines, the voltage level of said data electrode driving signals is maintained to be the same as that of said scanning electrode driving signal for non-selection time in the non-selection interval by setting a non-selection interval between scanning electrode driving signals of arbitrary two lines and the next two lines adjacent thereto by a predetermined interval.

23. The method for driving a matrix LCD panel as claimed in claim 19, wherein the non-selection interval is equal to the overlap interval.

24. The method for driving a matrix LCD panel as claimed in claim 19, including inverting the data electrode driving signal during the non-selection interval of the scanning electrode driving signal.

* * * * *

UNITED STATES PATENT AND TRADEMARK OFFICE

CERTIFICATE OF CORRECTION

PATENT NO. : 5,657,041

DATED : August 12, 1997

INVENTOR(S) : Choi

It is certified that error appears in the above-indentified patent and that said Letters Patent is hereby corrected as shown below:

Column 16, Line 65, after "and" insert --,--;

Column 17, Line 35, after "comprising" insert --:--.

Signed and Sealed this

Twenty-third Day of December, 1997

Bruce Lehman

*Attest:*

BRUCE LEHMAN

*Attesting Officer*

*Commissioner of Patents and Trademarks*